United States Patent [19]

Hosoya et al.

[11] 4,112,690

[45] Sep. 12, 1978

[54] METHOD AND CONSTRUCTION OF UNDERGROUND TANK WELL

[75] Inventors: Kazuo Hosoya, Tokyo; Munetaka Kubota, Hino, both of Japan

[73] Assignee: Kajima Kensetsu Kabushiki Kaisha, Tokyo, Japan

[21] Appl. No.: 741,679

[22] Filed: Nov. 15, 1976

[30] Foreign Application Priority Data

Nov. 22, 1975 [JP] Japan ..... 50-140458
Nov. 22, 1975 [JP] Japan ..... 50-140459

[51] Int. Cl.[2] ..... B65G 5/00; E02D 31/02

[52] U.S. Cl. ..... 405/57; 52/169.7; 405/55

[58] Field of Search ..... 61/0.5, 34, 35, 39, 61/50, 36 R; 52/169.7

[56] References Cited

U.S. PATENT DOCUMENTS 538,073 4/1895 Harris ..... 61/50
3,047,184 7/1962 van Bergen et al. ..... 61/0.5 X
3,436,919 4/1969 Shock et al. ..... 61/0.5
3,967,451 7/1976 Garbe ..... 61/0.5

FOREIGN PATENT DOCUMENTS 742,166 11/1943 Fed. Rep. of Germany ..... 61/50
476,333 5/1929 Fed. Rep. of Germany ..... 61/50
980,708 1/1965 United Kingdom ..... 61/50

*Primary Examiner*—Mervin Stein
*Assistant Examiner*—David H. Corbin
*Attorney, Agent, or Firm*—Meyer, Tilberry & Body

[57] ABSTRACT

Subjacent and lateral supporting soil for an underground tank is stabilized wherein a tank embedded therein is secured against flotation irrespective of the water table level of the surrounding soil. The lateral supporting soil is encased within a well and the subjacent soil is hardened to minimize seepage of water into the soil adjacent to the tank. Means are also provided to remove excess water from the confines of the well thereby minimizing flotation pressure on the tank.

3 Claims, 5 Drawing Figures

METHOD AND CONSTRUCTION OF UNDERGROUND TANK WELL

BACKGROUND OF THE INVENTION

This invention relates to an underground tank and a process for constructing same for storage of petroleum or liquified gases.

In general, it has been common practice in the construction of an underground tank to excavate earth while pumping accumulation of water due to seepage according to a well point construction process, deep well construction process or the like, and then to construct the underground tank in the excavated area. However, unless ground water is continuously pumped out after the construction of the tank, an upward pressure of water acts on the bottom portion of the underground tank. Thus, if the surrounding water table is relatively high, the floor slab of the tank could be cracked by this pressure.

Prior efforts to cope with this problem include a proposed underground tank, wherein there is provided a water collecting sump area under the bottom slab from which collected ground water is pumped out. However, ground water continuously flows from the surrounding ground into the collecting sump and hence pumping means must be maintained all the time, with the resulting expenditure of considerable time and effort and expense. Furthermore, in the event that the pumping means malfunctions, the tank is endangered with flotation and cracking stresses. Furthermore, to remove water from beneath the bottom slab of a tank requires complicated apparatus which is difficult to service.

It is therefore an object of the invention to provide an underground tank and a process for constructing same, in which ground water is conveniently and expeditiously controlled.

It is another object of the invention to provide an underground tank against which flotation pressures are minimized.

It is another object of the invention to provide a process for constructing an underground tank in which ground water immediately adjacent the construction site is isolated from ground water comprising the general water table.

It is another object of the invention to so minimize water seepage around an underground tank so that the failure of a pumping means does not result in dangerous flotation pressures building up around the tank.

It is another object of the invention to provide a process for constructing an underground tank for storing liquified gas, in which the surrounding ground is frozen to isolate the tank from the ground water.

It is still another object of the present invention to provide an economical process for constructing and maintaining an underground tank.

It is yet another object of the present invention to provide a process for constructing an underground tank in which in the absence of a water impermeable foundation strata of sub-soil, a water impermeable foundation may be artificially constructed with ease.

With the foregoing and other objects and features of the invention which will become evident from a reading of this specification, the invention consists of certain novel features of design and arrangement as illustrated in the accompanying drawings, and particularly pointed out in the appended claims, it being understood that various changes in the form, proportion, size and minor details of the invention may be made without departing from the spirit, or sacrificing any of the advantages, of the invention.

For the purpose of facilitating an understanding of the invention, there is illustrated in the accompanying drawings preferred embodiments thereof, from an inspection of which when considered in connection with the following description, my invention, its mode of construction, assembly and application and many of its advantages, will be readily understood.

Reference is now made to the drawings in which the same characters of reference are employed to indicate corresponding or similar parts throughout the several figures of the drawings, in which.

Figure 1:
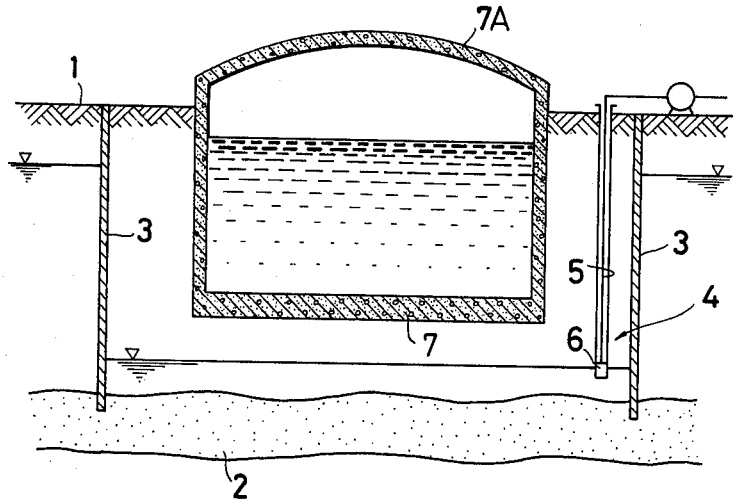
FIG. 1 is an elevational view in section showing an underground tank constructed according to the present invention.

According to the present invention, there is provided an improvement in an underground tank and a process for constructing the same, wherein an impervious well is provided to surround an excavation site, in which an underground tank is to be constructed. The well is sunk earthward until it reaches a water impermeable substrata. An underground tank is then constructed within the confines of the well while pumping out ground water which has seeped in between the tank and the well. Thereafter, the water discharging means is left in the place between the underground tank and the well, whereby ground water permeating into the well from the surrounding water table may be pumped out, as required.

According to another aspect of the present invention, there is provided a process for constructing an underground tank in which, in the absence of a water impermeable layer at a suitable depth beneath the tank, a hardening material is injected through a plurality of injection pipes into the underlying sub-strata which will support the tank and also minimize water seepage into the well. This hardening material is injected into the sub-soil simultaneously with the excavation of sub-soil water, wherein the hardening material is diffused along the streams of ground water toward the center of the well, thereby providing a solidified support base for the underground tank.

Referring now to the drawings with greater specificity, a water stop well 3 is provided in a manner to surround the earth in which an underground tank is to be constructed. The depth of the well 3 is such as to reach a water impermeable sub-strata layer 2. The construction of the well 3 is with sheet piles, such as steel plates or precast concrete plates driven into the ground in accordance with any continuous underground wall construction process well known to those skilled in the art.

A pumping means 4 is provided between the well 3 and the space in which an underground tank is to be constructed. The pumping means 4 is suited for a deep well construction process or a well point construction process. A sump 6 for an effluent pipe 5 is positioned at a level beneath bottom slab 7 of an underground tank 7A, and ground water which seeps from surrounding soil 1 into well 3 may be pumped out. Simultaneously, the center portion of earth surrounded by the well 3 is excavated for the subsequent construction of an underground tank.

Ground water permeating inwardly of the well 3 during the excavation or during the construction of the underground tank 7A is discharged by means of the pumping means 4, as required. Thereafter, the pumping means 4 is left in tact, even after the completion of construction of the underground tank 7A, so as to provide means to pump out ground water which has permeated inwardly of the well 3, when the level of ground water rises to a level close to the bottom surface of the tank bottom slab 7.

Figure 2:
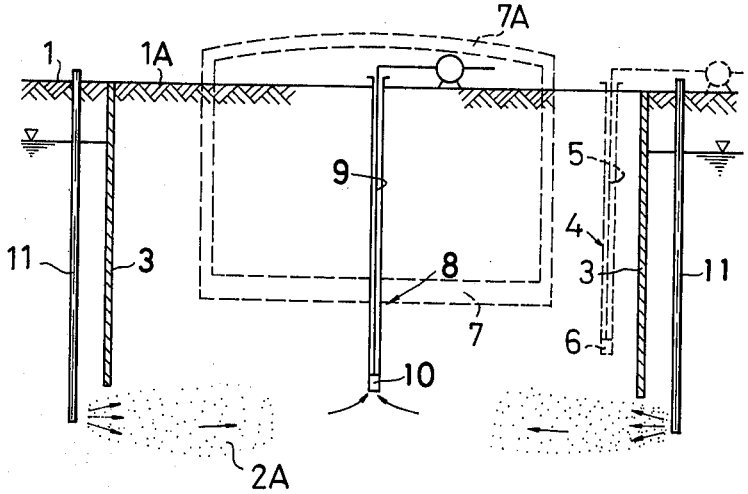
FIG. 2 is an elevational view in section of one method in accordance with the invention of artificially constructing a water impermeable tank base shown during the process of being formed.
Figure 3:
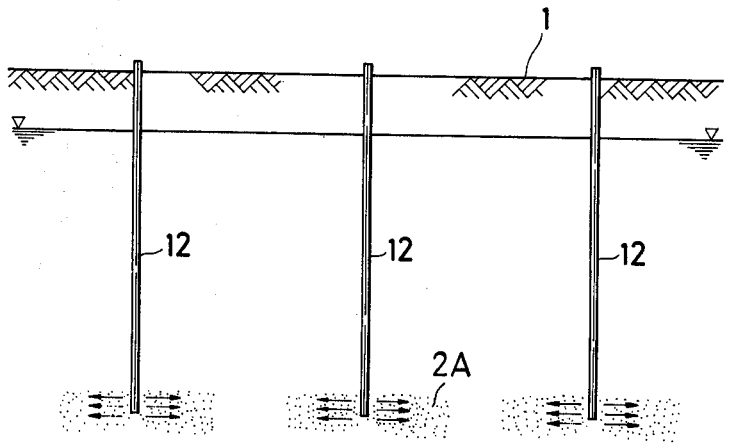
FIG. 3 is an elevational sectional view of another embodiment of the invention showing an artificially constructed water impermeable tank base during the process of being formed.

FIGS. 2 and 3 show processes for artificially reconstituting the sub-strata to provide a water impermeable layer 2A, in the absence of a natural water impermeable layer 2 at a suitable depth or in case of weak sub-strata or the like.

Referring again to FIG. 2, there is provided a well wall surrounding the construction site 1A in which the underground tank 7A is to be constructed. A pumping means 8 is disposed in the center portion of the construction site 1A with a strainer 10 positioned at the lower end of a water discharge pipe 9 being placed at the same level as that of the lower end of the water stop well wall 3. Soil hardening material injection pipes 11 are inserted into the ground, with the lower ends or exits thereof being at the same level as that of the water stop well wall 3. Under these conditions, a soil hardening material is injected through the injection pipes, while ground water is being pumped out by the pumping means 8. As a result, the hardening material is diffused by ground water which flows from the lower end of the water stop well wall 3 towards the center of the excavation site i.e., to the strainer 10 of the pumping means 8. With a sub-strata layer having soil hardening material diffused therein, upon hardening a water impermeable layer 2A is provided.

Figure 4:
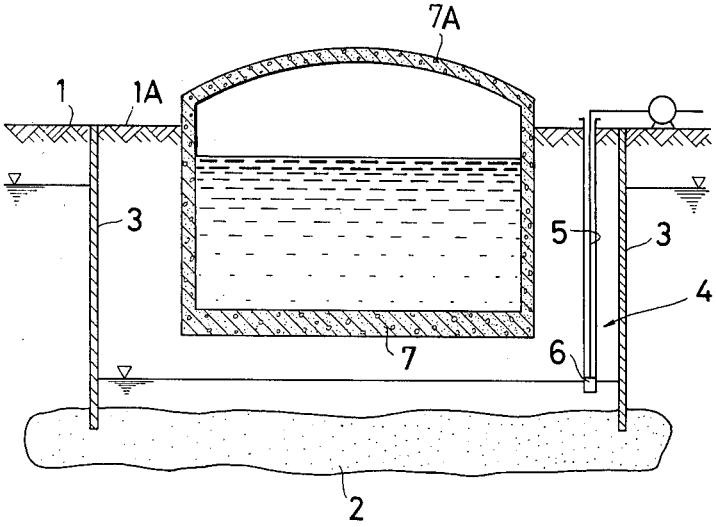
FIG. 4 is an elevational sectional view showing an underground tank constructed after a water impermeable tank base has been constructed artificially; and, FIG. 5 is an elevational sectional view of an underground tank constructed according to another embodiment of the present invention.

After the construction of the water impermeable layer 2A, another pumping means 4 is set to pump out water seepage collected in the earth surrounded with the water stop well wall 3. Thereafter, an underground tank 7A is constructed as shown in FIG. 4. Included among the soil hardening materials which may be employed in the present invention are cement milk and chemical compounds such as water glass and aluminum sulfate solution, water glass and calcium chloride solution and the like.

Referring again to FIG. 3, a plurality of soil hardening material injection pipes 12 are inserted into the ground, in which an underground tank is to be constructed, with the lower ends of the pipes 12 placed at the depth of a water impermeable layer to be formed later. A soil hardening material is injected under a high pressure into the ground surrounding the ground required for the construction of the underground tank 7A through the lower ends or injection exits of the pipes 12, thereby forming a water impermeable layer 2A.

Figure 5:
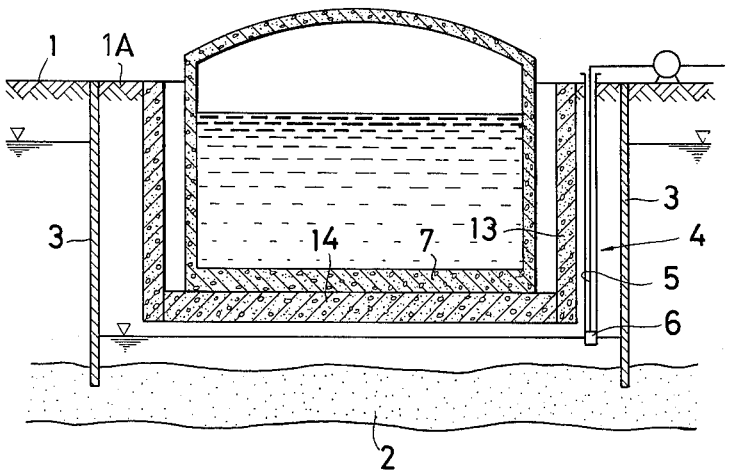

According to the embodiment shown in FIG. 5, an inner retaining wall 13 is constructed in the earth to be surrounded by the water stop well wall 3 prior to the construction of the underground tank 7A. The earth encircled with the retaining wall 13 is then excavated, and a base floor slab 14 is constructed in the bottom of the retaining wall 13. Thereafter, the underground tank 7A is constructed on the base floor slab 14. As a result of this preparation, the construction of the underground tank 7A is facilitated, and water pressure against the underground tank when completed and back filled is eliminated or restrained to within safe limits. This method of soil preparation is particularly advantageous in the construction of underground tanks for liquified gas, because the tank is insulated from direct contact with the ground, and hence the ground around the tank will not freeze due to the low temperature of the liquified gas.

In FIG. 5, the base floor slab 14 is separated from the retaining wall 13, so that the underground tank is not affected by the sinking or rising of the retaining wall.

What is claimed is:

1. The method of constructing an underground tank in water permeated soil, comprising the steps of:

sealing off an excavation area to reduce ground water seepage;

installing pumping means in said excavating area to be at a level beneath the bottom of the installed tank;

insertion of ground hardening material into the ground outwardly of and below said sealed off area while pumping out said ground water with pumping means from the center of said sealed off area to draw said hardening material inwardly toward the center of said sealed off area to provide a water impervious hardened base;

excavating said area above said water impervious hardened base sufficient to receive a tank therein;

installing said tank in said excavated area above said water impervious hardened base;

back filling around said tank;

leaving said pumping means in place and operable to remove water seepage from the back fill around said tank after underground installation thereof.

2. The method of constructing an underground tank in water permeated soil, comprising the steps of:

sealing off an excavation area to reduce water seepage;

installing pumping means in said excavation area at a level beneath the bottom of the to be installed tank;

pumping the ground water from said sealed off area with said pumping means;

excavating said area sufficeint to receive a tank therein;

installing a retaining wall within said excavated area;

providing an underground base floor slab within said retaining wall;

installing a tank on said slab within said retaining wall; and leaving said pumping means in place and operable to remove water seepage from beneath said slab after underground installation of said tank thereon.

3. The method of constructing an underground tank in water permeated soil, comprising the steps of:

sealing off an excavation area to reduce ground water seepage;

installing pumping means in said excavation area;

pumping the ground water from said sealed off area with said pumping means;

excavating said area sufficient to receive a tank therein;

providing a retaining wall within said sealed off area;

providing an underground base floor slab within said retaining wall;

providing said base floor slab free of any shifting movement of said retaining wall;

installing a tank on said slab within said retaining wall;

back filling around said retaining wall; and leaving said pumping means in place and operable to remove water seepage from the back fill around said retaining wall after installation of said tank therein.

* * * * *